United States Patent [19]

Schick

[11] Patent Number: 5,042,275

[45] Date of Patent: Aug. 27, 1991

[54] RESTORING DEVICE FOR A NEEDLE SELECTING APPARATUS OF A CIRCULAR KNITTING MACHINE

[75] Inventor: Wilfried Schick, Bitz, Fed. Rep. of Germany

[73] Assignee: Sipra Patententwicklungs-und Beteiligungsgesellschaft mbH, Tailfingen, Fed. Rep. of Germany

[21] Appl. No.: 243,447

[22] Filed: Sep. 12, 1988

[30]. Foreign Application Priority Data

Sep. 23, 1987 [DE] Fed. Rep. of Germany ..... 3731891

[51] Int. Cl.[5] ..... D04B 15/68; D04B 15/78

[52] U.S. Cl. ..... 66/223; 66/219

[58] Field of Search ..... 66/25, 75.1, 219, 222, 66/223, 224

[56] References Cited

U.S. PATENT DOCUMENTS 3,739,601 6/1973 Plath ..... 66/224 X
3,789,629 2/1974 Carrotte et al. ..... 66/223
3,823,579 7/1974 Schindele et al. ..... 66/219
3,824,809 7/1974 Canderton et al. ..... 66/223
3,854,304 12/1974 Hamma ..... 66/222 X
4,099,390 7/1978 Vinas ..... 66/219

FOREIGN PATENT DOCUMENTS 2118406 10/1972 Fed. Rep. of Germany ..... 66/219

*Primary Examiner*—Wm. Carter Reynolds
*Attorney, Agent, or Firm*—Michael J. Striker

[57] ABSTRACT

A restoring device for a needle selecting apparatus of a circular knitting machine has a housing mounted on the needle selecting apparatus, and a slider located in the housing for each set of selecting plates of the selecting apparatus. Each slider is displaceable in a direction of displacement of the selecting plates and is provided with a pressing surface and a withdrawal surface. The pressing and withdrawal surfaces of each slider act on all selecting plates of a respective set to displace the selecting plates to their operating and rest positions, respectively.

10 Claims, 2 Drawing Sheets

RESTORING DEVICE FOR A NEEDLE SELECTING APPARATUS OF A CIRCULAR KNITTING MACHINE

BACKGROUND OF THE INVENTION

The present invention relates to a restoring arrangement for a selecting apparatus of a needle selecting device of multi-system annular knitting machine.

More particularly, it relates to restoring arrangement which is used for a selecting apparatus with at least one set of parallel selecting plates which are movable from a rest position to an operative position and lockable in both positions, and wherein the selecting plates act on pattern feet of pattern plates, and movable by an electromagnetic adjusting device in a pattern-dependent manner from the rest position to the operating position.

The present invention also relates to a method of restoring the selecting plates of selecting apparatus of an annular knitting machine, and an annular knitting machine provided with the above-described units.

Selecting apparatuses of the above mentioned general type are used in needle selecting devices for an individual needle selection of limited pattern size with a regular repetition of the pattern after one machine revolution. The pattern is fixedly provided in the selecting apparatus. The pattern height is limited by the number of systems of the knitting machine and the pattern width is limited by the number of the pattern feet of pattern plates.

The pattern-dependent adjustment of the selecting apparatus is performed on the annular knitting machine. For this purpose in the U.S. patent application Ser. No. 456,581 which is a continuation of U.S. patent application Ser. No. 231,534 (now abandoned), an adjusting device was proposed which is mountable on a selecting apparatus of each system selectively for adjusting the selecting plates. Prior to the adjustment of the selecting plates of the selecting apparatus, all selecting plates must be brought in a joint initial position, in which they lie in a working region of the mounted adjusting device.

SUMMARY OF THE INVENTION

Accordingly, it is an object of the present invention to provide a restoring arrangement which returns all selecting plates of selecting apparatus during a pattern exchange on the annular knitting machine to a common rest position in a fast and reliable manner.

In keeping with these objects and with others which will become apparent hereinafter, one feature of the present invention resides, briefly stated, in a restoring arrangement for a selecting apparatus of the above mentioned general type in which instead of an adjusting device, a housing is mounted on the selecting apparatus, and a displaceable slider is supported in the housing for each set of the selecting plates displaceably in a displacing direction of the selecting plates, wherein each slider has a pressing surface which reacts on all selecting plates of the set of the selecting plates, and each slider also has a withdrawing surface which also acts on all selecting plates.

In accordance with another feature of the present invention the withdrawing surface of the slider can advantageously be formed on a hook end of the slider, and the slider in portions of its displacement path can additionally move transversely to the displacing direction of the selecting plates.

When the restoring arrangement is designed in accordance with the present invention it can be mounted one after the other on all selecting apparatus, as the above-mentioned joint electromagnetic adjusting device, for moving back the selecting plates of the selecting apparatus from an available pattern adjustment to a rest position for a new pattern selection by means of the adjusting device. An especial advantage is that the slider not only has a withdrawing surface and thereby engages all selecting plates located in an operational position and can return them to the rest position but also that each slider has an additional pressing surface with which it acts on the selecting plates located in a rest position and can move them in direction to their operational position.

In accordance with a further feature of the present invention, the invention proposes a method of restoring selecting plates of a selecting apparatus having at least one set of the selecting plates, comprising the steps of unlocking all selecting plates of the selecting apparatus; moving at least one slider provided for one set of selecting plates, in direction to pattern plates upon which the selecting plates act, and displacing all selecting plates which are located in a rest position by means of a pressing surface of the slider with acting on pattern feet of pattern plates; moving back of the slider in an opposite direction for engaging all selecting plates by a withdrawing surface of the slider and restoring all selecting plates from a joint operational position to a joint rest position; and locking all selecting plates.

By the additional displacement of all selecting plates which remain in their rest position to their operational position by the slider, all pattern plates and needle pushers located in the region of the selecting apparatus are radially outwardly displaced to a selecting position in the needle cylinder. In this position, the pattern plates and needle pushers remain, when afterwards all selecting plates are withdrawn to the rest position. The adjusting device which is provided for the new adjustment of the selecting apparatus must displace with its electromagnetic adjusting element or elements however the selecting plates to the operational position, and no additional forces are required for joint displacement of the pattern plates and needle pushers. Thereby a reliable selecting plates-selection is insured without high magnetic forces.

The invention also deals with a circular knitting machine which is provided with the above-mentioned restoring arrangement.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 2A is an explanatory view showing a pattern of displacement of locking strips when they move in and out of engagement with selecting plates;

DESCRIPTION OF THE PREFERRED EMBODIMENTS

Figure 1:
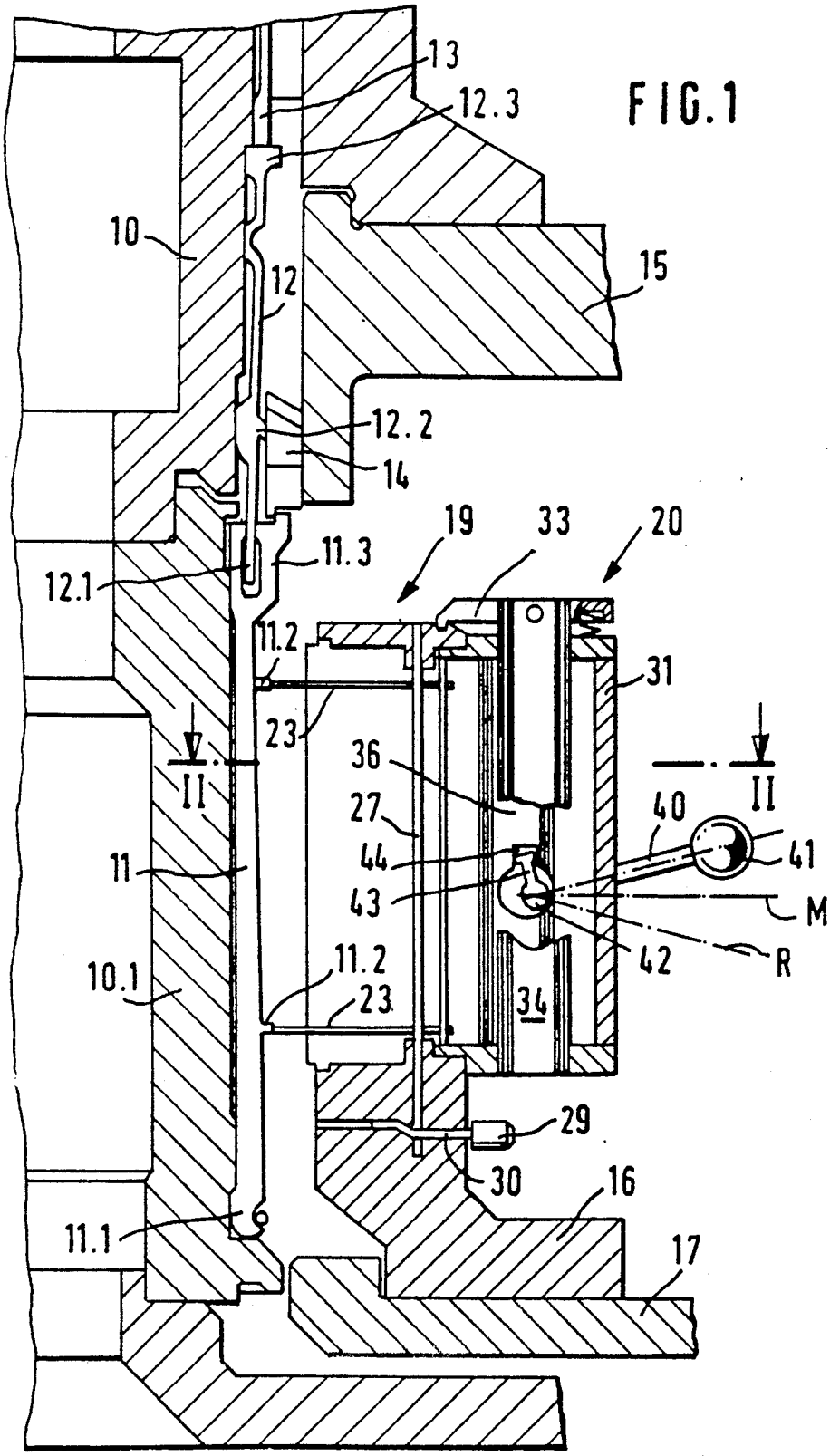
FIG. 1 is a partial radial section through a needle cylinder and a cam casing of an annular knitting machine in the region of selecting apparatus with a mounted restoring arrangement in accordance with the present invention.

FIG. 1 shows a part of a multi-system annular knitting machine. More particularly, the machine has a needle cylinder 10 with a lower part identified with reference numeral 10.1. Pattern plates or sinkers 11 are turnably supported on a lower end 11.1 of the lower part 10.1 of the needle cylinder. The upper end of the pattern plate 11 is formed as a fork head 11.3. A lower end 12.1 of a needle pusher 12 engages in the fork head 11.3 of the upper end of the pattern plate 11. The needle pusher 12 is supported in the needle cylinder 10 in a longitudinally displaceable and turnable manner. It has a control foot 12.2, and also a head part 12.3 which abuts against a lower end of a partially shown knitting needle 13.

A cam ring 15 of the annular knitting machine is provided with cam parts 14 which are mounted on the cam ring for controlling the longitudinal movement of the needle pusher 12. Moreover, a stationary supporting ring 17 supports a foot 16 of a selecting apparatus 19. A restoring device 20 is arranged on the selecting apparatus 19.

Figure 2:
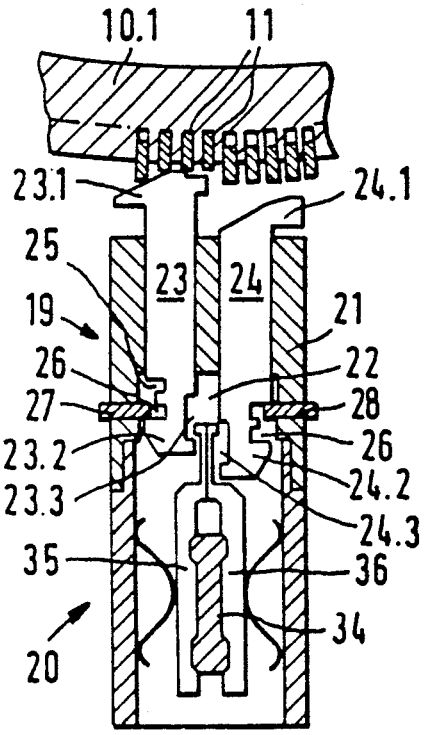
FIG. 2 is a view showing a horizontal section through the selecting apparatus and the restoring arrangement, taken along the line II—II in FIG. 1, with the restoring arrangement in a rest position.
Figure 3:
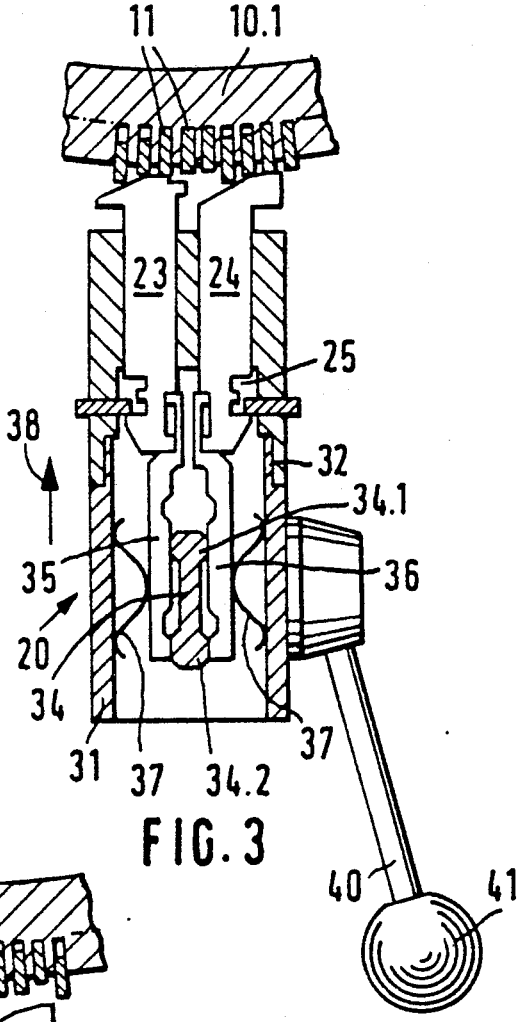
FIG. 3 is a view showing a section substantially corresponding to the view of FIG. 2, with displaced sliders of the restoring arrangement.
Figure 4:
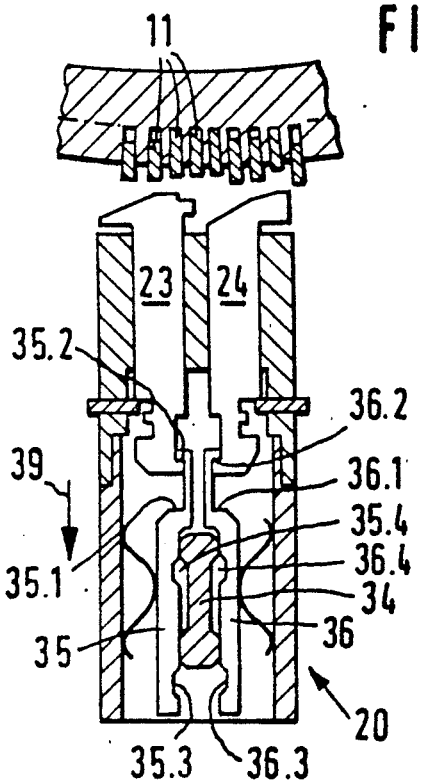
FIG. 4 is a view showing a section substantially corresponding to the view of FIG. 2, with withdrawn sliders of the restoring arrangement and with selecting plates of the selecting apparatus in a rest position.

As can be seen from FIGS. 2–4, the selecting apparatus 19 has two adjacent sets of selecting plates 23 and 24 which are arranged over one another and parallel to one another. The selecting plates 23 and 24 are supported in the housing 21 of the selecting apparatus 29 so as to form an intermediate space 22 therebetween and so as to be displaceable radially relative to the needle cylinder. Each selecting plate 23, 24 of the selecting plate set is oriented in a known manner to a height in which the pattern plates 11 with a pattern foot 11.2 can be provided. In FIG. 1, a pattern foot 11.2 is located at its maximum height and a pattern foot 11.2 of another pattern plate 11 is located at its minimum height, in connection with one selecting plate 23 of one selecting plate set which acts on them.

The selecting plates 23 and 24 of both selecting plate sets each have a head 23.1 and 24.1 which is provided with a incline for the pattern feet 11.2 of the pattern plates 11. The selecting plates 23 and 24 also have striking ends 23.2 and 24.2 for an adjusting element of a not shown adjusting device, and also two lateral arresting notches 25 and 26 for a locking strip 27 or 28 which is common for one whole selecting plate set. These selecting plates are displaceable each between a rest position in which the selecting plate 24 is located in a position shown in FIG. 2, and an operative position in which the left selecting plate 23 is located in a position shown in FIG. 2. In these both positions each of them is arrested by means of the locking strips 27 or 28. The locking strips 27 and 28 can move by means of a band switching rod 30 which ends in a gripping head 29 as shown in FIG. 1. The locking strips move between their locking position and their releasing position as follows. Upon pulling the gripping head 29 from a position shown in FIG. 1, the inclined portion of the switching rod 30 moves the locking strips 27 and 28 upward and outward as shown in dash lines in FIG. 2*a*, to a releasing position. On pushing the gripping head 29 the locking strips 27, 28 move downward and inward into the locking position thereof in which they lock the selecting plates 23 and 24 in a predetermined position of the selecting plates. The locking strips 27 and 28 have respective slots **27*a* and 28*a* which engage respective pins 27*b* and 28*b* fixed in the housing 21 and which pins provide for respective displacement of the locking strips 27 and 28. The arrangement for displacement of the locking strips does not form a part of the present invention. In FIGS. 2–4 the locking strips 27 and 28** are shown in their releasing position.

FIGS. 2–4 also show the construction of the restoring device 20. The individual parts of this device for the sake of better visibility are distributed between FIGS. 3 and 4. The device has a housing 31 provided with stepped walls 32 which are centrally fitted on the downwardly open housing of the selecting apparatus 19 and fixed with an arresting latch 33 which is shown in FIG. 1. A central control plate 34 extends through the whole length of the housing 31 and is expanded at its front and rear ends by wedge surface heads 34.1 and 34.2. Sliders 35 and 36 are provided at both sides of the control plate 34. They are supported displaceably in the displacing direction of the selecting plates 23 and 24 of the selecting apparatus and move against the restoring force of schematically shown springs 37 transversely to the displacing direction as well. The displacement direction of the selecting plates 23 and 24 and of their associated sliders 35 and 36, which displacement direction is radial relative to the needle cylinder, is identified with directional arrows 38 and 39 in FIGS. 3 and 4.

Both sliders 35 and 36 are formed identical. However they are inserted in a mirror-inverted manner in the housing 31 of the restoring device and extend over the whole height of the restoring device. They are provided in their front part with a pressing surface 35.1 and 36.1 and a hook end 35.2 and 36.2 which form a restoring pulling surface and which are shown only in FIG. 4 for the sake of clarity. On their abutment side which faces toward the control plate 34, both sliders 35 and 36 are provided with two wedge surface grooves 35.3 and 36.3, and 35.4 and 36.4, for inserting the wedge surface heads 34.1 and 34.2 of the control plate 34.

FIGS. 1 and 3 show a turing lever 40 which ends in a gripping head 41. The turning lever 40 is connected with a switching shaft 42 which is inserted in a not shown lateral opening of the housing 31. The switching shaft 42 also extends in a not shown manner through an opening in the stationary control plate 34 and carries a switching cam 43 for each of both sliders 35 and 36, of which one switching cam is shown in FIG. 1. Each switching cam 43 engages in a switching notch 44 which is formed in slider 35 and 36. The handle 40 with the switching shaft 42 is turnable as a switch in the housing 31. By means of turning lever, a simultaneous and joint adjustment of both sliders 35 and 36 is performed in a way which shall be described hereinbelow.

FIG. 2 shows a restoring device 20 in an initial position in which both sliders 35 and 36 are in their central position in which the wedge surface heads 34.1 and 34.2 of the stationary control plates 34 engage in the wedge surface grooves 35.3, 35.4 or 36.3, 36.4 of the sliders 35 and 36 and both sliders with their hook ends 35.2 and 36.2 tightly abut against one another. In this position the hook ends 35.2 and 36.2 can be inserted in the intermediate space 22 between both selecting plate sets of the selecting apparatus 19, as shown in FIG. 2. When the restoring device 20 in this position places the sliders 35 and 36 on the selecting apparatus 19 and anchors by means of the arresting wedge 33, both locking strips 27 and 28 of the selecting apparatus 19 are released through the switching rod 30. Then, the turning lever 40 supported in the housing 31 is turned first from the central position M to the position shown in FIG. 1. Thereby both sliders 35 and 36 are moved to the position shown in FIG. 3 in direction of the arrow 38. During this longitudinal movement of the sliders 35 and 36, both sliders 35, 36 are moved by the wedge surface heads 34.1 and 34.2 of the stationary control plate 34 against the force of the restoring springs 36 transversely to the longitudinal adjustment direction so that the hook ends 35.2 and 36.2 of the sliders 35 and 36 are inserted in the lateral recesses 23.3 and 24.3 of all selecting plates 23 and 24 as shown in FIG. 3. FIG. 3 also shows that the striking ends 23.2 and 24.2 of the selecting plates 23, 24 which are shown only in FIG. 2 are acted upon by the pressure surface 35.1 and 36.1 of both sliders 35 and 36 shown in FIG. 4. Thereby all selecting plates 23 and 24 of both selecting plate sets are displaced to their full operating position inwardly. As a result of this all pattern plates 11 and needle pushers located in the inlet region of these selecting plates 23 and 24 are radially inwardly pressed into their cylinder grooves.

After this the turning lever 40 is moved in an opposite direction through the center position M back to the turning position R which is identified with a dash-dot line in FIG. 1. During this restoring movement all selecting plates 23 and 24 are engaged by the hook ends 35.2 and 36.2 of both sliders 35 and 36 and together move back to their rest position.

For removing the restoring device 20 from the selecting apparatus 19, the turning lever 40 is set from the turning position R to the center position M. Both sliders 35 and 36 are placed by springs 37 to the non-spread position shown in FIG. 2. For a subsequent new adjustment of the selecting apparatus 19, instead of the return device 20 an electromagnetic adjusting device is placed on the selecting apparatus 19. Finally, the needle selection of the selecting plates 23 and 24 is secured by return movement of the switching rod 30 and the locking strips 27 and 28.

It will be understood that each of the elements described above, or two or more together, may also find a useful application in other types of constructions differing from the types described above.

While the invention has been illustrated and described as embodied in a restoring device for a selecting apparatus of circular knitting machines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A restoring device for a needle selecting apparatus device of a multi-system circular knitting machine in which the selecting apparatus has at least one set of parallel selecting plates movable between a rest position and an operating position and acting upon pattern feet of pattern plates,. the restoring device comprising a housing mountable on a selecting apparatus and having a slider which is provided for each set of selecting plates and displaceable in a displacing direction of the selecting plates, each of said sliders having a pressing surface arranged to act on all selecting plates of a set of selecting plates, each of said sliders also having a withdrawing surface which also acts on all selecting plates of one selecting plate set.

2. A restoring device as defined in claim 1, wherein each of said sliders has a hook end provided with said withdrawing surface, each of said sliders in portions of its displacement path being also additionally movable transversely to the displacing direction of the selecting plates.

3. A restoring device as defined in claim 1; and further comprising a stationary control plate having a wedge surface, each of said sliders being longitudinally guided on said control plate and movable transversely to said displacement direction under the action of said wedge surface.

4. A restoring device for a selecting apparatus of a needle selecting device of a multi-system annular knitting machine in which the selecting apparatus has two sets of parallel selecting plates movable between a rest position and an operating position and acting upon pattern feet of pattern plates, the restoring device comprising a housing mountable on a selecting apparatus and having a slider which is provided for each set of selecting plates and displaceable in a displacing direction of the selecting plates, each of said sliders having a pressing surface arranged to act on all selecting plates of a set of selecting plates, each of said sliders also having a withdrawing surface which also acts on all selecting plates of one selecting plate set; a stationary control plate having a wedge surface, each of said sliders being longitudinally guided on said control plate and movable transversely to said displacement direction under the action of said wedge surface, said sliders being inserted in an intermediate space between both sets of the selecting plates and arranged at both sides of said control plate.

5. A restoring device as defined in claim 4, wherein said sliders are movable from a central initial position in the displacing direction of the selecting plates and transversely to said displacing direction jointly; and further comprising means for jointly moving said sliders.

6. A restoring device as defined in claim 5, wherein said means for jointly moving said sliders includes a joint driving element.

7. A restoring device as defined in claim 6, wherein said joint driving element is supported in said housing and formed as a manually movable turning lever with a switching shaft acting upon said sliders.

8. A restoring device as defined in claim 7, wherein said sliders have switching notches, said switching shaft being provided with switching cams which are engageable in said switching notches of said sliders.

9. A restoring device as defined in claim 4, wherein said sliders are identical and arranged in a mirror-inverted symmetrical manner relative to said control plates.

10. A multi-system annular knitting machine, comprising a needle selecting device; a selecting apparatus for said needle selecting device and including at least one set of parallel selecting plates which are movable between a rest position and an operational position and lockable in both positions; and a restoring device for said selecting apparatus and including a housing which is mountable on said selecting apparatus, a displaceable slider provided for each set of said selecting plates and arranged in said housing displaceably in a displacing direction of said selecting plates, each of said sliders having a pressing surface which acts on all selecting plates of each set of selecting plates, each of said sliders also having a withdrawing surface which also acts on all selecting plates of one set of said selecting plates.

* * * * *